US010845166B2

(12) United States Patent
Campbell

(10) Patent No.: US 10,845,166 B2
(45) Date of Patent: Nov. 24, 2020

(54) SURVEILLANCE DEVICE

(71) Applicant: Robert Marshall Campbell, Miami, FL (US)

(72) Inventor: Robert Marshall Campbell, Miami, FL (US)

(73) Assignee: Robert Marshall Campbell, Miami, FL (US)

( * ) Notice: Subject to any disclaimer, the term of this patent is extended or adjusted under 35 U.S.C. 154(b) by 0 days.

(21) Appl. No.: 16/404,603

(22) Filed: May 6, 2019

(65) Prior Publication Data

US 2019/0339047 A1 Nov. 7, 2019

Related U.S. Application Data

(60) Provisional application No. 62/667,499, filed on May 5, 2018.

(51) Int. Cl.

| | |
|---|---|
| ***F41J 5/10*** | (2006.01) |
| ***F41G 11/00*** | (2006.01) |
| ***G08B 1/08*** | (2006.01) |
| ***F41G 1/54*** | (2006.01) |
| ***F41G 1/36*** | (2006.01) |

(52) U.S. Cl.

CPC *F41J 5/10* (2013.01); *F41G 1/36* (2013.01); *F41G 1/545* (2013.01); *F41G 11/003* (2013.01); *G08B 1/08* (2013.01)

(58) Field of Classification Search

CPC .... F41J 5/10; F41G 1/36; F41G 1/545; F41G 11/003; G08B 1/08

USPC ..... 42/132

See application file for complete search history.

(56) References Cited

U.S. PATENT DOCUMENTS

| | | | | |
|---|---|---|---|---|
| 9,291,424 | B2 * | 3/2016 | Tagarro | F41J 5/10 |
| 9,936,115 | B2 * | 4/2018 | Tagarro | F41J 5/10 |
| 10,323,904 | B1 * | 6/2019 | Batten | H04N 5/63 |
| 2007/0039226 | A1 * | 2/2007 | Stokes | F41C 23/16 42/146 |
| 2015/0285586 | A1 * | 10/2015 | Tagarro | F41J 5/10 348/211.11 |
| 2015/0369554 | A1 * | 12/2015 | Kramer | H04N 9/8205 386/227 |
| 2017/0026563 | A1 * | 1/2017 | Tagarro | F41J 5/10 |
| 2017/0059265 | A1 * | 3/2017 | Winter | F41A 17/08 |
| 2017/0109940 | A1 * | 4/2017 | Guo | G06T 19/20 |
| 2019/0301833 | A1 * | 10/2019 | Campbell | F41G 1/30 |

* cited by examiner

*Primary Examiner* — Samir Abdosh

(74) *Attorney, Agent, or Firm* — The Brickell IP Group, PLLC; Javier Sobrado; Nicole Fundora

(57) ABSTRACT

A surveillance system comprising a housing dimensioned to enclose a plurality of cameras and one or more viewing windows to allow light to pass through the housing. A wife transmitting module sends and receives wireless data via an antenna and a mounting rail is attached to the housing to mount the housing to a firearm.

18 Claims, 7 Drawing Sheets

Figure 1:
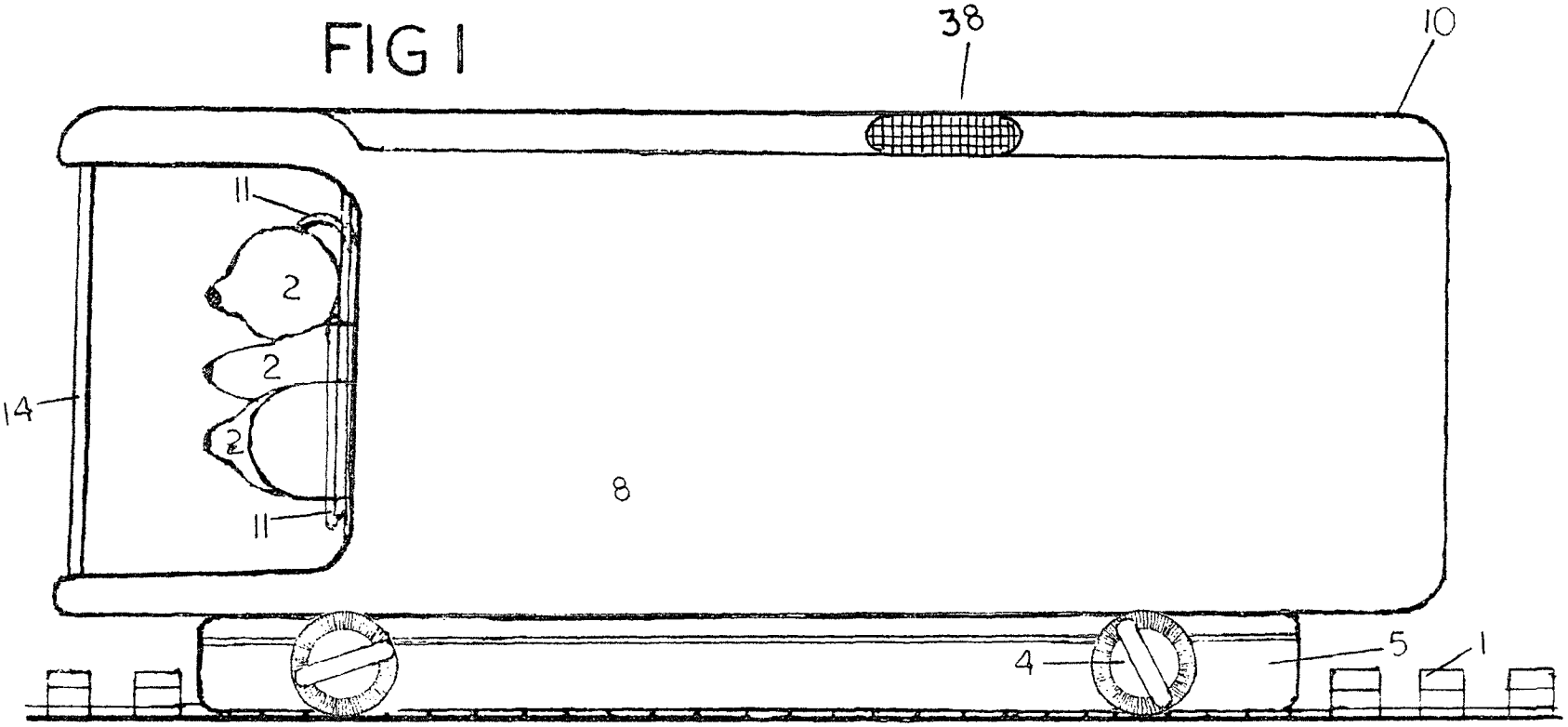

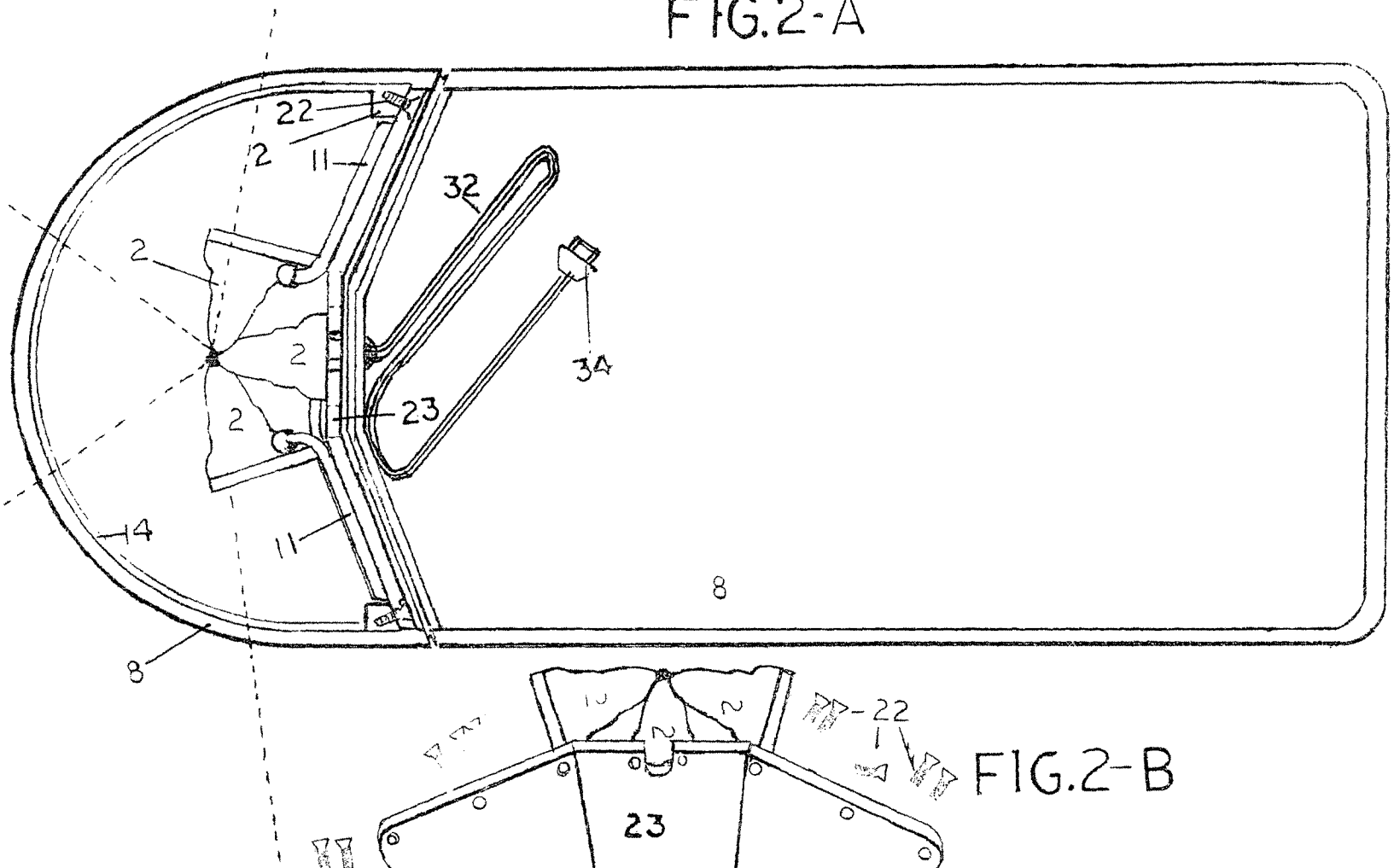
FIG.2-A
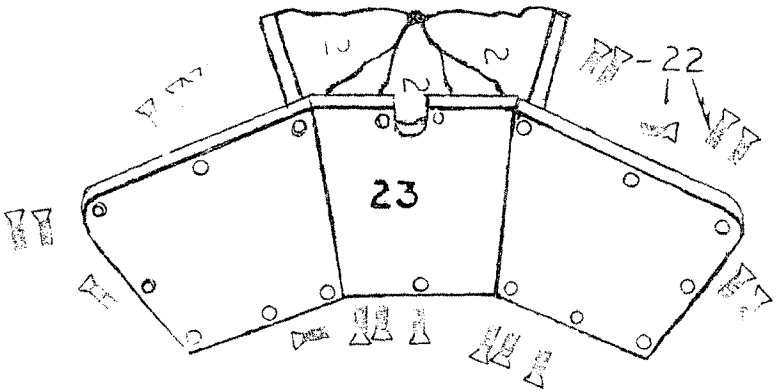
FIG.2-B

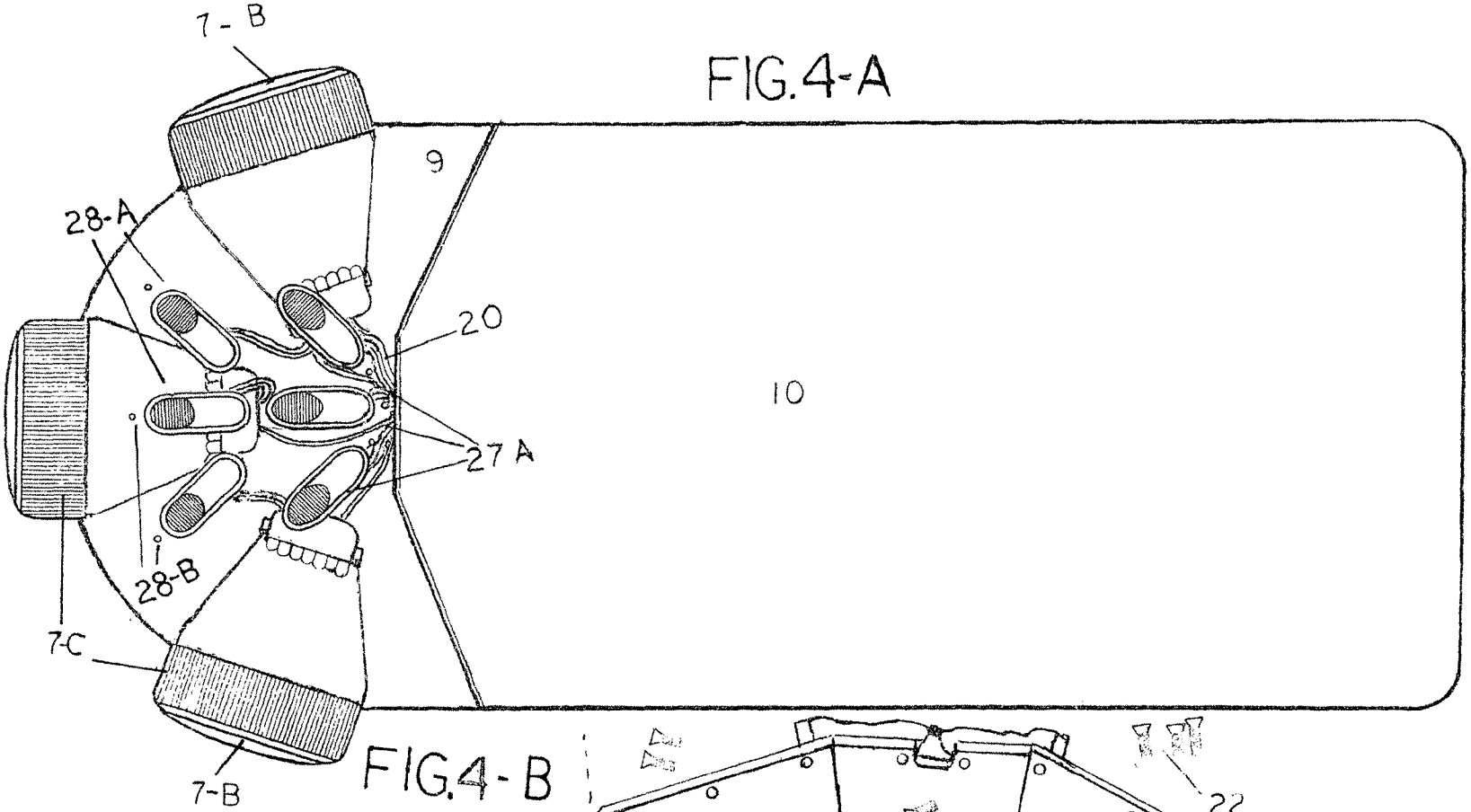
FIG.4-A
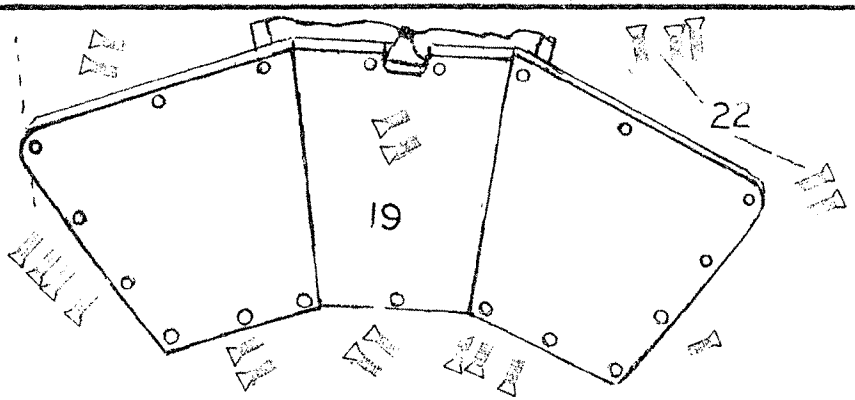
FIG.4-B

SURVEILLANCE DEVICE

CROSS REFERENCES TO RELATED APPLICATIONS

This application claims priority to U.S. Provisional Application No. 62/667,499 filed May 5, 2018 and entitled "Surveillance Device", the disclose of which is incorporate in its entirety.

FIELD OF INVENTION

The present invention generally relates to the field of firearm optics and accessories. Firearm optics and accessories consist of a wide range of devices that attach to and enhance the performance of, or simply work in conjunction with a fire arm, all of which are produced to enhance the abilities of the firearm in one way or another. These accessories consist of various types of sights, scopes, night vision, laser sights, range finders, etc. as well as regular or infrared high-powered lights, tripods, various types of mounting rail systems, etc. This invention would fall more into the sight category but more particularly, this device is a new type of tactical surveillance sighting device as well as accessories for it devised to enhance its tactical sighting and surveilling abilities.

It is well appreciated in the art of weaponry and particularly rifles and hand guns. There have been numerous attempts to develop more efficient firearm accessories that provide a soldier with a level of safety and control in theaters of combat where gun fire must be exchanged to the preservation of the soldier's life; in that first responders, soldiers, and law enforcement personnel often encounter hostile combatants, violent actors or offenders who carry pistols, rifles, or other weapons. Military scenarios, battles and other military operations often occur in urban theaters of combat requiring armed forces to patrol and battle the enemy in towns and cities in these theaters of combat, and our troops often come under fire from enemy combatants and must regularly take cover behind obstacles such as buildings, vehicles, trees, homes, etc. with the remedy to these scenarios being extremely dangerous, that rarely end well.

The problem is that with the friendly combatants' entire body being behind protective cover, a clear linear view to locate the point of fire, or to be able to locate or accurately engage advancing hostile enemy combatants, when it's the only option to the soldier's survival, cannot be accomplished without looking over or around these fortified structures, exposing himself as a target while doing so. This as well as the countless other scenarios and duties required of our troops, where an inability to effectively surveil areas and engage targets from positions of protective cover have historically been responsible for countless causalities. The applicant being a Vietnam veteran himself and all too aware of these things, as well the miserable failures of the prior art to provide our troops with a viable solution to this problem has been the driving force in his provision of a real solution to this problem. A solution destined to prevent countless future casualties especially in its solution to the ongoing problems that today's troops face on a daily basis in theaters of urban combat that has created all new dangers and challenges for today's armed forces that the applicant's solution literally provides our troops with abilities to once and for all solve.

Included in the following application is a new type of surveillance device that when integrated into another invention of the applicant's provides the user with a fully unobstructed view of his entire surrounding at all times as well as the target images from other sights and scopes on the firearm in a manner that provides the user with countless never previously achievable sighting and surveilling abilities, from any position in relation to the firearm, enabling as little as one soldier the full ability take and maintain total control of a battle from any position of total protective cover such as from behind the corner of a wall vehicle out of a ditch or other without the slightest part of his body being exposed to incoming fire while doing so providing a full solution acclaimed by high ranking military personal and equipment advisers consulted as inventions possessing far superior tactical sighting abilities than anything previously devised, that will provide all of our troops with a level of defensive safety and tactical control providing abilities, that nothing previously devised has ever come close to providing them, that will not only reduce a great number of U.S. casualties, but will also make a tremendous impact on our armed forces' level of efficiency and effectiveness. In fact, one official for our special forces consulted remarked that these inventions are doubtless destined to prevent a large percentage of U.S. casualties, that's sure to prove evident at even greater levels in theaters of urban combat, in that they will not only be availed to, but will also provide all of our ground troops far greater abilities of defense and tactical control, which in turn will provide our armed forces with abilities to fight a far more precise and exacting war that operates at a level of efficiency and control, with a far superior tactical advantage, that with even a seriously reduced number of ground troops, will very easily and effectively both identify the true hostile enemy combatants, as well as resolve the conflict in a manner where only the true aggressors need pay for their actions. These abilities will also provide our troops with the ability to fight a much more humane war as well, especially theaters of urban combat. This due to these inventions providing our troops with the ability to maintain a fully unobstructed view of their entire surroundings, and in turn, a full awareness of threat demographics, in that more often than not, hostiles are intermingled in the same environment with innocent non-hostile civilians that quite often are also being victimized by the enemy, with the lines between the two often becoming blurred, and with these abilities to easily distinguish between the two, will doubtless create substantial reductions in collateral damage as well as the serious reduction of our own casualties. All of which additionally helping this nation establish a reputation for our armed forces of both that of strength but also that of compassion and perceived by those in other countries as more of the good guys, there to help them!

BACKGROUND

This application is for an electronic surveillance optic named SURVEILLANCE DEVICE which is the core invention of this application. This surveillance device in every way was devised to to provide their highest possible level of services and abilities to another already patented invention of the applicants, NAMED SIGHT ADJUSTABLE SMARTPHONE MOUNT FOR FIREARMS in a manner to produce the utmost level of effectual abilities and provision to the highest level and most needful and advantages of service abilities providable to this other tactical smart phone mount invention of the applicants, which is actually a computerized tactical sighting device with all of its technology provided by a smart device that preset versions of the original invention will litterly be transformed into an all new and different type of tactical firearm sight possessing levels of defense, safety, tactical, and control providing abilities far superior to anting believed achievable. Once integrated into the applicant's aforementioned other invention, provide another already patented invention of the applicants named SIGHT ADJUSTABLE SMARTPHONE MOUNT FOR FIREARMS smart phone mount to the creation of an entirely new device by means of both mechanical and electronic integration. This surveillance device consisting an electronic surveillance optic mountable to standard military picatinny accessory mounting rails for firearms. These mounting rails being standard equipment on almost all tactical firearms, with numerous providable, for any application or positional adaptation. This surveillance device's service is in that of its provision of a fully unobstructed 270 degree previously unattainable view of the users sourindings most advantages position of adaption primarily being out on an end portion of said mounting rails of standard issue and special tactical rifles. This surveillance devices provision of its previously unattainable 270 degree service of that of a fully unobstructed 270 degree view, provided to a smart device intern becoming an integral portion of a 360 degree totally unobstructed view of the users entire sourindings with the additional 90 degree portion thereof providing the rest of the 360 degree view provided by means of an additional rear viewing camera. This camera being an integral portion of a positionally adjustable armature providing the camera portion thereof, position adjust-ability, to the acquisition of the perfect vantage point of a fully unobstructed 90-degree view of the aria behind the user. This fully unobstructed 90 degree view providable at all times to the user from positions on either side of the firearm which it maintains its ongoing and uninterrupted provision thereof due to its mounting base providing its attachment to and positional adjustment of the armature and rear viewing camera and thus contributed provision integration with the original invention with their service being that of a fully unobstructed 270 degree The rear viewing camera portion of this mount making up the rest of the surveilled image documented in a continuation of the patented invention of the applicant's named SIGHT ADJUSTABLE ROTATING SMART DEVICE MOUNT FOR FIREARMS. Of which the core invention of this application SURVEILLANCE DEVICE was devised to work in conjunction with. This the original invention possessed abilities never previously achieved of which this invention achieved in four very efficient ways for which the patent office allowed all four to be patented as one and granted as well as granted all 20 very broad claims for this invention as well. This original invention as well as all continuation and continuation in part applications are the result of an ongoing drive of the applicant toto make this invention as well as other inventions of the applicants like it perform at their absolute highest levels service and performance possible. This surveillance device the invention of this application, as well as the rear viewing camera, being only two of many that have additional the c this base invention consisting only of a profoundly unique smart device mount that provides the user with both vertical and lateral adjustment of the smart device mounted therein for perfect parallel alignment with the smart phone or small tablets cameras lens to the reticle or crosshairs of any sight or scope, mounted on the firearm with the smart device mounted therein, thus acquiring its targeting images from any sight or scope on the firearm and displays the image of same in the screen of the smart device. his smart device mount possessing the additional ability of maintaining its provision of said target image is provided to by means of their mount directly to the smart device mounted therein displaying the digital display thereof to the user, with all four of these original tactical smart device mounts possessing the added profound ability of maintaining their provision of said target image to the user from any position he would have to position himself in relation to the firearm to remain totally behind protective all while providing him with the full ongoing accurate use of his firearm from proactive cover with all versions of this tactical smart device mount with even these four les refined versions of them providing the user with a relatively high levels of efficiency while doing.

More recent models of these tactical position-able smart device mounts of the applicant's not only possess more abilities but due to the applicant's driving force to ever refine and improve their abilities due to the ramifications thereof the most recent one is expected to operate at profound levels or speed and efficiency that with them fully equipped with this surveillance device of this patent application of this invention and others of his like the applicant has been told will significantly reduce casualty levels The previous invention of the applicant also devised by the applicant also devised to advance these tactical smart device safety providing abilities the rear viewing cameras provides in its operational mode working in perfect operational unison with the tactical smart device mounts very fast fluid level ease and efficiency it operates all effortlessly maintaining an entire 360 degree visual of his entire surroundings as well as this little surveillance devices most advantages mounting position being out under the muzzle totally out of the way without even the possibility of hindering the operating ability of other sights scopes or any other gear weather standard issue or special tactical as well as in the profound level of service they provide they can be made to be very small and weighing only ounces. Adding nothing to the solder as well as other inventions of the applicants that acquire their target images from a broad range of both standard, as well as specialty target acquiring sights and devices on a firearm, that they in turn provide these acquired targeting images to a smart phone or small tablet solidly mounted, in a multi-position-able smart device mount, that's attachable to the mounting rails of the firearms and positionally adjustable thereon, to provide the user thereof the perfect vantage point to the screen of the smart device mounted therein as well as from any position he would have to position himself in his relation to the firearm to the accurate employment thereof, from positions of total protective cover. This mount additionally possessing a rear viewing camera also originally invented for the provision of its fully unobstructed view of the aria directly behind the user to make up for the unattainable portion of the 360 degree view this surveillance device of this patent application which was devised to acquire by means of mechanical and electronic integration back into the applicant's original invention both by means of a symbiotic mechanical relationship and electronic integration this rear viewing camera integral to an armature that's also positionally adjustable thereon, to the provision of the cameras perfect vantage point of the area behind the user, that this camera maintains at all times. This due to the user's vantage point of the smart device's screen provided by the position adjustability of the smart device mount itself. All of these things along with other features and engineering refinements, providing the soldier with full accurate use of the firearm from any position he would have to position himself to remain behind protective cover, with an amazing level of speed fluidity and ease of operation. With only one thing lacking in these other inventions of the applicant's ability to provide our troops with the level of defense and safety they so desperately needed, in all theaters of combat, as well as in the countless and ongoing duties required of today's troops on a daily basis, with these dangers exponentially compounded due to the all-new dangers urban warfare has created, responsible for the largest numbers of U.S casualties which has creating all new challenges for our troops, and those leading them. Problems that, until now, there's been no remedy. The applicant's full knowledge of the tragedies war creates as well as the injustices thereof where th war mongers' evil forces and hostiles have to be paid for by the sufferings and loss of life of putting their lives on the line to stop them putting their lives on the line to stop them.

This tactical surveillance device invention is a result of the ongoing driving force of the applicant, who being all too aware of these things, has literally resulted in a remedy to them, in that this invention was devised in every way to enable his other electronic tactical sights working in conjunction with it with the abilities that nobody consulted had ever dreamed possible and are devised in a way to provide the user with a full unobstructed view of his entire surroundings at any or at all times, with either full screen, or centered in the screen along with the 360 degree view of the surveillance cameras images with all of the options of image selection and integration provided by presently available apps devised for home and industry security systems, although highly specialized ones are also being developed for them. This surveillance device was primarily devised to work in conjunction with the sight adjustable smart device mount which is an already issued patent of the applicant's as well as one continuation in part for it, also issued with two more pending that provide highly refined levels of efficiency and range of versatility and overall use to all other aforementioned abilities. This proves most evident in that of positional ease and fluidity pertaining to that of target acquisition from any target viewing device on the firearm. There's yet another two inventions of the applicant that also possess the ability of providing the target image from any other sight or scope or other target viewing device on the firearm to the smart device but the incorporation of their optional digital display therein, as well digitally providing their acquired target images to be viewed in the screen thereof, in the same manner and by the same means of the same as well as app, which in turn provides the user with optional secondary targeting abilities acquired from the other sights, scopes, and targeting devices on the firearm, with all viewing options performed by extremely fast and easy finger mouse and tap commands on the screen of the smart device performed by the user with one hand, and faster than one could blink the screen thereof always right in front of the user, positionally adjusted to provide the user with the perfect vantage point of the smart device screen by means of the multi position-able smart device mount providing all images provided by the surveillance devices along with the targeting images to the user in a manner that these two devices co-depend on each other, enabling them to achieve abilities never previously believed as possible with their unique and never previously achievable levels of defensive safety and tactical control providing abilities. The applicant is assured, this will save countless lives, being due to their co dependence on each other's targeting image as well as the smart device it displays its surveilled image in and from any position the user is, in relation to the firearm, along with the superimposed target image from any other sight or scope on the firearm with a perfectly centered reticle in the screen thereof, providing lightning fast and easy target acquisition with the added abilities to selectively zoom in or out on any of the images. This along with very effective night vision, along with all of the other abilities the smart device provides itself, not limited to that of G.P.S. or recording for evidentiary purposes, but also by the vast and far too many to mention abilities such as the computing abilities of the smart device working in conjunction through electronic integration of the target image of any of the other sights, scopes, range finders, night viewing devices, or any other target viewing device on the firearm, in the screen of the smart device, all while maintaining a fully unobstructed view of his entire surroundings provided by the integration of this surveillance device, devised to not only to work in perfect harmony with the applicants' aforementioned inventions, but to literally create an entirely new one, with profoundly effective and never previously achievable levels of both defensive safety and tactical control providing abilities, never previously achievable by anything previously devised.

The broad range of abilities and enhancements this invention provides and enables the applicant's prior tactical sighting inventions, that these surveillance devices were devised to/and work in conjunction with, is profound, in that not only does it additionally provide the user with a fully unobstructed view of his surroundings, all while providing him the added abilities that variable zooming provides, enabling the user the ability to maintain a full visual of his surroundings to the revelation of the residing dangers therein, but also with the additional ability to instantly to go from a fully non-magnified view, to that of a high powered scope with variable zooming abilities, provided by the smart device working in conjunction with them. This, as well as, the provision of these abilities in any direction of his entire perimeter providing the user with the ability to instantly zoom in on numerous previously hidden dangers such as sniper positions or preemptive attacks from enemy combatants positioning themselves for the launching of R.P.G.s or other fragmentation grenades. This, as well as, these surveillance device's provision of a full range of these services 24-7 due to very effective night viewing abilities they possess. All of which, nothing previously devised has ever come close to accomplishing, by means of the integration of the prior aforementioned inventions of the applicants with this surveillance device, devised in the manner the applicant devised it, to in turn produce an entirely new and complete combination tactical surveillance targeting device. Doubtless to make an impact on the level of this nation's security far greater than anything previously devised.

This in addition to all components thereof not only being devised in a manner that enables them to be applicable to all firearms our armed forces employ, but this new surveillance device portion thereof was also devised in a manner to employ its undiminished and maximum level of services and abilities to all other components thereof, while not only maintaining a totally unobstructed view of the area, but also being devised to provide its maximum level of service mounted out on the end portion of the bottom rail of the firearm, in turn providing its full level of services without interfering with, or diminishing the ongoing level of performance provided by any of the other equipment employed on the firearm in any way while doing so. But the ability perhaps providing the greatest service being the applicant's devising them, not only in a manner that they can be employed on literally any firearm our armed forces employs, but also devising them in a manner that they maintain their undiminished abilities while doing so and thus, devising them in a manner to provide the maximum level of their defensive safety and tactical control providing abilities to absolutely all of our troops and our allies troops, whether ground forces, special forces, law enforcement, such as S.W.A.T., secret service, homeland security whether standard issue firearms or special tactical, and all others, who daily have to put themselves in harm's way to defend the freedoms and provide the security for all others of this nation at a level never previously believed attainable, and all with a couple of devices needing to weigh only ounces, that the applicant is being told could lighten the soldier's existing heavy load by many pounds simply due the cumbersome and comparatively inadequate equipment it will render as obsolete.

These radically superior defensive safety and tactical control providing abilities being vital and will prove as absolutely essential to the survival of countless numbers of our troops, in the performance of a broad range of duties required of them, as well as in countless unforeseeable battlefield scenarios, requiring them to put themselves in harm's way on a daily basis which is historically responsible for countless numbers of US causalities.

These duties and scenarios only becoming far more serious in recent years due to the all-new dangers and challenges urban warfare has created and our troops fall victim to on a daily basis. Urban theaters of combat include environments where not only are they dealing with a broad range of dangers at every turn and at any time, in that not only can an enemy be anywhere with innocent civilians are quite often intermingled with the hostile combatants that without time, safety and control to properly distinguish between the two, often ends in the peril of innocent, civilians simply being victimized by the actual hostile combatant. Or of the soldier's peril at their hands, with the hostile free to do it again. In theaters of urban combat, our troops will often come under fire and have to duck behind any protective cover available such as the corner of a building, behind a tree, vehicle or behind a berm, etc. creating an extremely dangerous but all too common scenario that rarely ends well, in that a soldier's only remedy, with no route of escape, requiring him to expose himself to the incoming fire he's taken cover from first to locate the point of fire, as well as to assess the area for other advancing hostiles, or developing enemy scenarios or dangers befalling them, with the only option to the soldier's survival, and a possible favorable outcome relying on his ability to access the, true battlefield conditions to access and possibly neutralizing or possible positive resolve to the imminent danger he's in, being in total reliance of him actually locating the point of fire, advancing hostiles or other enemy scenario's with his only possible resolve requiring him to commit and actually, stick his head out to look over or around protective cover to do so, with enemy hostile combatants just lying in wait for him to do so scenarios of this nature are an ongoing and everyday occurrence in theaters of urban combat where hostiles have limitless advantages positions to take-up and optional modes of attack where our troops inability to be made aware of the dangers sourindings them has historically been responsible for a large percentage of us casualties. These dangers proving true in almost all combat scenarios facing todays ground troops as well as in almost all duties required of them on a daily basis's constantly requiring them to place themselves in harm's way and all the hidden dangers continually befalling them therein weather from snipers or enemy combatants that have taken up positions just inside open windows or on top of building or when having to clear them from those buildings and having to to view down hallways and into various rooms and hiding places when clearing these buildings of the very snipers, and enemy combatants, they were under fire from, or when surveilling enemy strongholds; or simply when on watch or patrol and having to traverse between one position to another, and having to look around the corners of buildings or down alleys or other to insure safe passage. These to mention a few of the dangers our troops must face on a daily basis simply due to their ability to reveal them without exposing themselves to those very same dangers to do so, historically responsible for countless numbers of U.S. casualties rarely ending well. All of our troops inabilities to properly has to ability to maintain a visual of his surroundings with the added abilities of being able to zoom in on any area to reveal hidden dangers such as sniper positions or enemy combatant's taking up positions just inside open windows on top of buildings as well as greater targeting abilities from greater distances. This device also provides our troops with abilities to view down hallways and into various rooms and hiding places when clearing buildings of snipers, of other enemy combatants, surveilling enemy strongholds; or simply traversing between one position to another, and having to look around the corners of buildings or down alleys or other to insure safe passage. In fact, this device would be employed by the soldier during the performance of a broad range of duties required of him from the least to the absolute most dangerous, that have historically been responsible for a countless number of U.S. casualties.

This as well, providing our troops with the time and control to access the entire battlefield demographics, to both distinguish between the true enemy aggressors and those that quite often are simply being victimized by them as well. All of this and more while the user remains totally behind protective cover without the slightest p in that with the added abilities that the smart device's screen itself provides the user, in that this screen actually being the screen of a very sophisticated computer, which a smart phone actually is, turns this device into an extremely high tech computerized surveillance device with the ability to view all of the images provided by the cameras in the screen of the smart device, either individually, or all at once, along with the added ability to select various images and enlarge or selectively arrange them on the screen. All of these things providing the user with not only far superior surveillance abilities than anything previously devised, but also providing him with the ability to very thoroughly surveil his entire perimeter, from a totally safe, secure area, without any portion of his body being exposed to incoming fire while doing so, simply by means of sticking the muzzle of the firearm with this tactical surveillance device mounted on either the top, but primarily mounted on bottom mounting rail thereof, and out just past the edge of a building, wall, tree, vehicle, out of a trench, over a berm, or other, where the surveillance device can acquire a clear linear view.

These, as well as far too many other services and abilities to list that a smart device provides the user, when working in conjunction with this tactical surveillance device, of course, the greatest of which being the ability to remain in total control of the battle, and to maintain these abilities whether at night or during the day, along with the many control and safety providing abilities that this invention possess. The applicant has been assured that this invention, along with the level of safety and control providing abilities that it provides, this tactical surveillance device will make a tremendous impact on our military's efficiency and effectiveness, as individual images provided by these surveillance devices would all be viewable in the screen of the smart device operating in this mode of operation, and the smart device would require no cellphone service or internet connection of any sort. In other words, this device would operate perfectly anywhere in the world whether in the middle of the Sahara Desert or in a boat in the middle of the ocean on the screen of the smart device, although there are downloadable apps that would make this process very quick and easy to jump very quickly and easily from desired camera image, to desired camera image. These images are also digitally enlargeable as well, and can be digitally zoomed in and out. This, as well as many other image-enhancing abilities that are availed to this surveillance device that are provided by the smart device working in conjunction with them that require no in turnet or even cellphone service connection of any sort.

The smart device mount of the original invention additionally being rotatable so that the smart device screen can be viewable from any position that the user would have to position himself in relation to the firearm. This surveillance device would primarily be mounted on the forward portion of bottom mounting rail of the firearm where it could obtain a full unobstructed view of the areas in front, as well as to either side and partially behind the firearm in an un-widened or zoomed view of 270 degrees, with the rear viewing camera, that is height and angle adjustable from the back portion of the smart device mount, making up the rest of the 360 degree viewing radius. These cameras would provide the user with this full un-obstructed view of the area, without obstructing the view of the target viewing device that the smart device is acquiring its target image from in any way, which would primarily be mounted on the top mounting rail of the firearm. The rail mountable housing of this surveillance device would include at least three infrared viewing cameras, as well their own radio transmitters. There are a number of different types of these cameras and radio transmitters applicable in this surveillance device but the type of cameras and radio transmitters illustrated in all of drawings and descriptions of this application. This being of the same type that are employed in most of the higher-end, infrared viewing spy cameras. These cameras are of the same basic types of cameras employed in the higher quality smart phones, and are available in the same approximate size and quality, with resiliency ratings of 1080 p and greater. The main differences with these cameras being that they are also equipped with either their own integral or separate little WIFI transmitters that transmit their image to smart devices such as smart phones or other. These cameras are also available with infrared viewing abilities, which in most cases this device would employ. This additionally equips this device with quite amazing night viewing abilities, when working in conjunction with infrared illuminators, limited only by distance, but with these infrared illuminators' beams width being adjustable, these lights are capable of illuminating areas in a much lesser field of view at rather amazing distances. Both infrared LED and laser illuminators are also very energy efficient, which simply means that a great deal of light can be produced by these infrared illuminators for extended periods of time with very little battery use. The cameras themselves also require very little battery use as well. The tiny radio transmitting module's power consumption can be a bit more but most of these radio transmitting modules in these spy cameras transmit their signal several hundred feet and still requiring very little power, with many of these spy cameras being in things like pens or wrist watches with very little battery capacity, in that their power requirements are actually totally proportionate to the strength of their signal and the distance that they transmit their signal, and with the smart device never needing to be more than a couple of feet away, and the user never needing the signal to be transmitted much farther, it would simply mean that these devices could be produced in very energy efficient models with an extended run time, between battery replacement or recharging.

This invention's abilities to reveal the hidden dangers that would befall our soldiers without their having to expose themselves to these dangers would be more often than not, absolutely critical to their very survival. This, as well as, this invention's added abilities to reveal these dangers to them no matter what position that they would have to position themselves in relation to the firearm, or what position of protective cover they would have to position themselves in or behind without having to expose any part of his body to incoming fire in any way, while not only remaining totally out of the line of fire but also while remaining in total control of the battle, as well as to maintain these abilities whether at night or during the day, along with the many other abilities that this invention possesses that the applicant has been assured will prevent a large percentage of U.S. casualties.

PRIOR ART

Current available solutions devised to reveal hidden dangers or to provide the user with surveillance and tactical abilities capable of maintaining a visual of the user's entire surroundings, that provide the user of the firearm with the ability to remain totally behind protective cover while doing so, and that is applicable to any firearm with a mounting rail. In fact, The applicant could not find any prior art capable of accomplishing the tasks or that possess the abilities of the applicant's device. All seem to only be devised with their entire efforts directed solely towards the abilities of engaging targets from behind protective cover, with probably only one that completes that task with any measurable level of effect, and all others detectable provision of service to that effect being extremely limited, in that their solution, whether being a firearm or device, was actually devised to provide a completely different service, usually that of high-tech sighting, with very little innovative forethought or engineering directed towards their surveilling abilities at all, nor do they provide any solution of any sort to the overall defensive safety, control, and tactical needs of our troops. Nor could they in any way even be a component to affect thereof, due firstly to their inability possibly perform the full task themselves, and secondly due to their solution limited as they all are 'never being devised with any provision of adaptation or incorporation enabling another solution to the possibility of a greater effect or level of service Although even if they would they would all would fall miserably short of providing any real level of effect to the full problem. This due to the many problems that none of the prior art has been capable of solving. And only now due to the applicant's solution to the effect of the overall solution in any way of their i total problem completion, inabilities' or overall effect of another solution to the overall solution, or completion, of and in thus doing totally crippling their solution with all falling miserably short of providing a viable solution to the problem as a whole the actual levels needed and usually even that with very limited levels of efficiency. With all seriously lacking and falling miserably short in one way or another in the overall functional range of their abilities they could possibly provide at a remotely acceptable level of safety and control providing abilities to our troops in the broad range of actual battlefield scenarios that constantly befall them. Of course, with some failing far worse than others.

Currently available devices devised to reveal hidden dangers or to provide surveillance abilities to the user of a firearm, while the user of the firearm remains totally behind protective cover, that were actually devised to work in conjunction with and enhance the abilities of another invention that is also a tactical firearm accessory or even a device that possess the abilities or operates in the same manner that has either been integrated into other tactical firearm accessories, or are an integral part of a tactical firearm, the applicant has been unable to find. With only one device found that could be remotely construed as operating in a similar manner and this would be found in the Israeli corner shot which is an invention which consists of a pistol mounted on the forward portion of a ratcheting bendable stock. This firearm also has a video camera with a super imposed reticle that is wired to a 2½ inch monitor with an LED screen that is simply put into service by locking the sight screen into its non-rotatable 90 degree viewing position in relation to the rifle stock, viewable at lower portion of the left side of the firearm stock, that the camera supplies its target image to the user from. The ratcheting bendable forward portion of this firearm, that the pistol and camera with its superimposed reticle is mounted to is pivot-ably connected to the stock portion and swings, and is lockable to either side of the firearm, to surveille the area for potential dangers, as well as to engage same if deemed necessary. So, in that respect this tactical firearm possesses a camera that supplies an image to a monitor for a tactical purpose. This purpose actually invented and devised, to provide the user with the ability to quickly locate and engage targets from a safe secure position rather than for actual surveillance purposes, but in this respect, one could say that it possesses surveillance abilities, in that this camera and monitor also provide the user with the ability to remain behind protective cover and view an area of potential danger while doing so but this is where the similarities end. The many differences include, but are not limited to, this device possessing only one camera that just views the area where the firearm is actually aiming, and in a much narrower field of view, and just directly in front, in that this tactical firearm was primarily invented to be able to engage targets from a safe position. Of course, a target must be located before it can be engaged and this firearm performs an adequate job of that. The camera and its mode of operation is completely different than that of the applicants as well in that, it is also being one of many components that make up a tactical sighting system that simply provides its targeting image by wire to its own monitor, that is an integral part of this firearm. This tactical firearm suffers from a great many deficiencies as well that proves evident in many ways. The first of these basic differences being in their exclusivity unto themselves and their inability to provide their abilities to the various types of firearms that are actually availed to our forces to fit in and operate in harmony with the The lack of versatility and adaptability in the prior art renders their tactical abilities limited as they are of very little use, in that their abilities rarely get into the hands of those that need them the most. These problems wouldn't even exist if only a little additional forethought and a wider conceptional vision of the overall tactical and safety providing needs of our armed forces was taken into consideration as a whole, along with greater effort put forth, directed towards innovative engineering, directed towards the development of devices with a greater range of application, versatility, effectiveness, and adaptability, so that a greater level of safety and control could be provided for all of our troops where these abilities are so desperately needed. The prior art has so miserably fallen short of providing them, for instance, the Israeli corner shot being an entire firearm with all its components being exclusive to itself, as well as, all of its components being dependent on each other to operate as a functioning unit, along with its firepower limited to the fire power, range, and accuracy to only what a pistol can provide. For this reason and others, this firearm is also seen and used by the military, only as a secondary or specialty firearm and not to take the place of a soldier's primary firearm, meaning that this entire firearm would have to be carried into battle along with the rest of the soldier's equipment, not only adding the additional weight of eight and a half pounds to the soldier's existing heavy load, but it also gets in the way and literally hinders the soldier's effectiveness when not in use. And because of these things, also limiting the soldier's range of mobility, and abilities, and thus hindering the soldier's effectiveness in the use the rest of the equipment availed to him, hindering him in the performance of other duties required of him, it is for these reasons and others that this firearm and its limited safety providing abilities are rarely availed to our troops. This firearm is also limited in the positions that a soldier must place himself to the effective use of the firearm due to the location and non-position-ability of the target screen, meaning that the user can only operate the firearm from the left side of the firearm which can present a problem in some of the more restrictive places a soldier would have to position himself to remain out of the line of fire, while maintaining full effective use of the firearm's tactical abilities. This tactical firearm, provides only a view of the area where its aiming which provides the user with no abilities to maintain a visual of the areas to either side or behind the user to provide the user with advanced warning of things like, advancing hostile combatants, or other developing enemy scenarios, or a number of other impending dangers that could befall him from any of his surroundings, the knowledge of which quite often being absolutely critical to his survival. The biggest problem with the prior art by far is in its lack of versatility, adaptability and its inability to actually equip any of the actual firearms that are availed to our troops with any of their actual tactical abilities limited as they may be, and it's their exclusivity unto themselves being an integral part of a particular firearm, more than anything that renders them of no real use to our troops or only availed to a very small percentage of them, to say nothing of the lack of overall range of control and safety providing abilities and services that they provide the user in actual battle field scenarios. This tactical firearm is also limited in its technical abilities as well. That forethought and innovative engineering directed towards something as simple as the incorporation of a common smart device, may have been a better choice, as an electronic and technology source if possibly applicable to its solution, which would enable them with a vast number of other extremely useful abilities both tactical and non-tactical, in that a smart phone or smart device is actually a highly sophisticated computer that if realized and initially devised to be properly integrated into their solution, with compatible electronic components to take full advantage of each other's abilities, this alone can radically expand an electronic device's range of abilities, and range of use and most importantly, the range of safety providing abilities, that they could have possibly offered the user. Of course, no degree of electronic sophistication can make up for a lack of vision, innovation, forethought and creative engineering required to devise a device that most effectively and efficiently provides the user with the ability to reveal and be made aware of the existing dangers in his soundings that could befall him at any time especially when these abilities are absolutely critical to the user's survival.

This is why a device that much better provides these services is so desperately needed, but also a device that possess a broad range of adaptably, versatility, and applications, so that these control and safety providing abilities can be provided to everybody in our armed forces in need of these abilities, This is why an invention like the applicant's is so desperately needed, in that there is no prior art that possesses any real ability to provide our troops with a level of safety and control that actually avails them with the ability to remain totally behind protective cover while maintaining a constant visual of their entire soundings while doing so. Even patent of the applicant's, the combination of which will not only be applicable to any firearm that our armed forces, special forces, secret service, or law enforcement employs and that will radically outperform the prior arts control and safety providing abilities in numerous ways, that the applicant has been assured will save countless lives, but this invention working as a standalone device and simply working in conjunction with the user's smart phone or computer watch or glasses like iWatch or Google Eye would also provide tremendous control and safety providing abilities and would not only also be applicable to all of the firearms availed to those that defend this nation but could also provide them with these abilities, very cost effectively, in that this device could be manufactured to the highest of mill spec. standards for a very low per unit cost t simply meaning they can easily provided to all those that are in so desperate need of them

SUMMARY

The core invention documented in this application named is a surveillance device for firearms. This surveillance device includes a camera housing attachable to a firearm mounting rail. This housing including a camera or cameras and at least one W.I.F.I. Transmitter that provides digital at least one digital image transmission trans cameras are positionally oriented to receive images from said, at least one opening or window. These images would be transferred and receivable to a smart device to be viewable in a digital display therein. This surveillance device, and in some models equipped with at least one infrared illuminator, said housing also housing at least one battery in electrical communication with said cameras.

It is the objective of the applicant of this invention to ever improve and enhance the overall range of function and abilities of his other tactical sight's To provide them the highest level of safety providing abilities, to in turn provide our troops, law enforcement and others with the maximum level of safety and control providing abilities, to surveil areas of potential danger with the highest level efficiency possible, even with the user's body remaining totally behind protective cover and even while under heavy incoming enemy fire while doing so.

It is the objective of the present invention to provide our troops law enforcement and others with the highest level of defensive safety, and tactical control, providing abilities in a broad range of battlefield scenarios as well as in the performance of duties required of them requiring them to put themselves in harms way on a daily basis, responsible for countless us causalities, by providing him with not only with the ability with to maintain a visual of his entire surroundings with the added abilities that variable zooming will provide with the instant ability to go from a non-magnified to that of a high powered scope in any direction of his entire perimeter including the area behind him all while providing him these abilities 24-7 with very effective night viewing abilities as well while maintaining full accurate use of his firearm the ability to engage targets to the prevention of his peril even wile under heavy incoming fire from positions of full protective cover without the slightest portion of his body being exposed to incoming fire, while doing so.

It is yet another objective of the present invention, to provide a surveillance device for our troops, with the maximum range efficiency, adaptability, versatility and overall ease of operation and use, as well as, to provide the maximum level of safety and control providing abilities to our armed forces, that is extremely operationally efficient.

It is yet another objective of the present invention to provide a soldier or law enforcement with a view of his entire surroundings from full protective cover at night, as well as during the day, with very effective night viewing abilities.

It is another objective of the present invention to provide improved surveillance abilities relative to the firearm, thereby providing the user with a wide unobstructed view of an area in the screen of the smart device, providing the user with the ability to surveil an area in a theater of combat from any position the user would have to position himself in relation to the firearm, to reveal origins of incoming fire, advancing hostile combatants, developing enemy scenarios, sniper positions, etc. This, all from a safe, secure position with the user's entire body remaining behind protective cover such as from behind walls, trees, buildings, vehicles, trenches, berms etc. without exposing the user as a target while doing so, with the maximum degree and range of safety, efficiency, and overall use.

Its yet another objective of the present invention to provide a firearm accessory, that that maximizes the range, ease, efficiency, adaptability versatility and overall use, to provide the maximum level of safety and control to our armed forces and others, that is both extremely operationally efficient, while remaining simplistic in the mechanical composition of their devised components and mode of function. This, providing the ability to manufacture these tactical surveillance devices that are both highly dependable and very low maintenance.

It is yet another objective of the present invention to provide our troops law enforcement and others with the highest level of defensive safety and tactical control providing abilities in a broad range of battlefield scenarios as well as in the performance of duties required of them requiring them to put themselves in harms way on a daily basis responsible for countless us causalities by providing him providing them not only with the ability with to maintain a visual of his entire surroundings with the added abilities that variable zooming will provide with the instant ability to go from a non-magnified to that of a high powered scope in any direction of his entire perimeter including the area behind him all while providing him these abilities 24-7 with very effective night viewing abilities as well while maintaining full accurate use of his firearm the ability to engage targets to the prevention of his peril even wile under heavy incoming fire from positions of full protective cover without the slightest portion of his body being exposed to incoming fire, while doing so.

It is yet another objective of the present invention described in this application to provide advanced tactical firearm surveillance devices for firearms that are small and light, yet possess a wide range of safety providing abilities that are also highly versatile, quickly and easily attachable, portable and more importantly, applicable to any type of firearm employed by our military, both that of ground troops and special forces as well as all types of firearms employed by our law enforcement, such as S.W.A.T. and secret service personnel. But also, with the numerous other, safety providing abilities that this device will provide for all personnel that put their lives on the line every day, to provide safety and preserve the freedom for the people of this great nation.

Finally, it is an objective of the present invention to provide an improved surveillance accessory for firearms that incorporates all of the above-mentioned functions, abilities, objects, and features.

BRIEF DESCRIPTION

FIG. 1 is a profile view of a surveillance device attached to a firearm's mounting rail #1. Number 14 is the viewing window where three combination cameras and WIFI transmitting modules #2 receive their images from, in front and to each side, and partially behind the user. Number 1 is the mounting rail on the firearm primarily a picatinny rail.

Number 5 is the rail mount that is an integral part of the surveillance device that attaches the surveillance sight to the mounting rail #1, in an embodiment taught herein. This surveillance device includes a battery compartment located in the aft portion of housing #8, battery compartment lid #10, *a* forward viewing window #14A, Switches and indicator lights #27A and #27B, and Combination cameras and WIFI transmitting modules #2, in accordance with the principles of the present embodiment.

FIG. 2A is an overhead view of the surveillance device as if the top portion of the surveillance device was removed to reveal the inner components in an embodiment taught herein. Number 2 are the combination cameras and WIFI transmitting modules, #14 is the forward viewing window where cameras #2 receive their surveilled image. Number 23 is an optional design of a removeable wall that is integral to the camera mounting bases, #32 is the wire that completes electrical communication between the removeable battery pack and the switches, #23 is a removable wall that is attached to a cleat #21 that extends around the inner perimeter of the housing #8 that wall #23 is attachable to in accordance with the principles of the present embodiment.

FIG. 2B is a slightly off skew image of removeable wall integral to the combination camera and WIFI transmitting module basses in an embodiment taught herein. Number 22 are mechanical fasteners for the attachment of the wall #23 to a cleat extending around the inner perimeter of the housing for the attachment of the wall #23 in accordance with the principles of the present embodiment.

Figure 3:
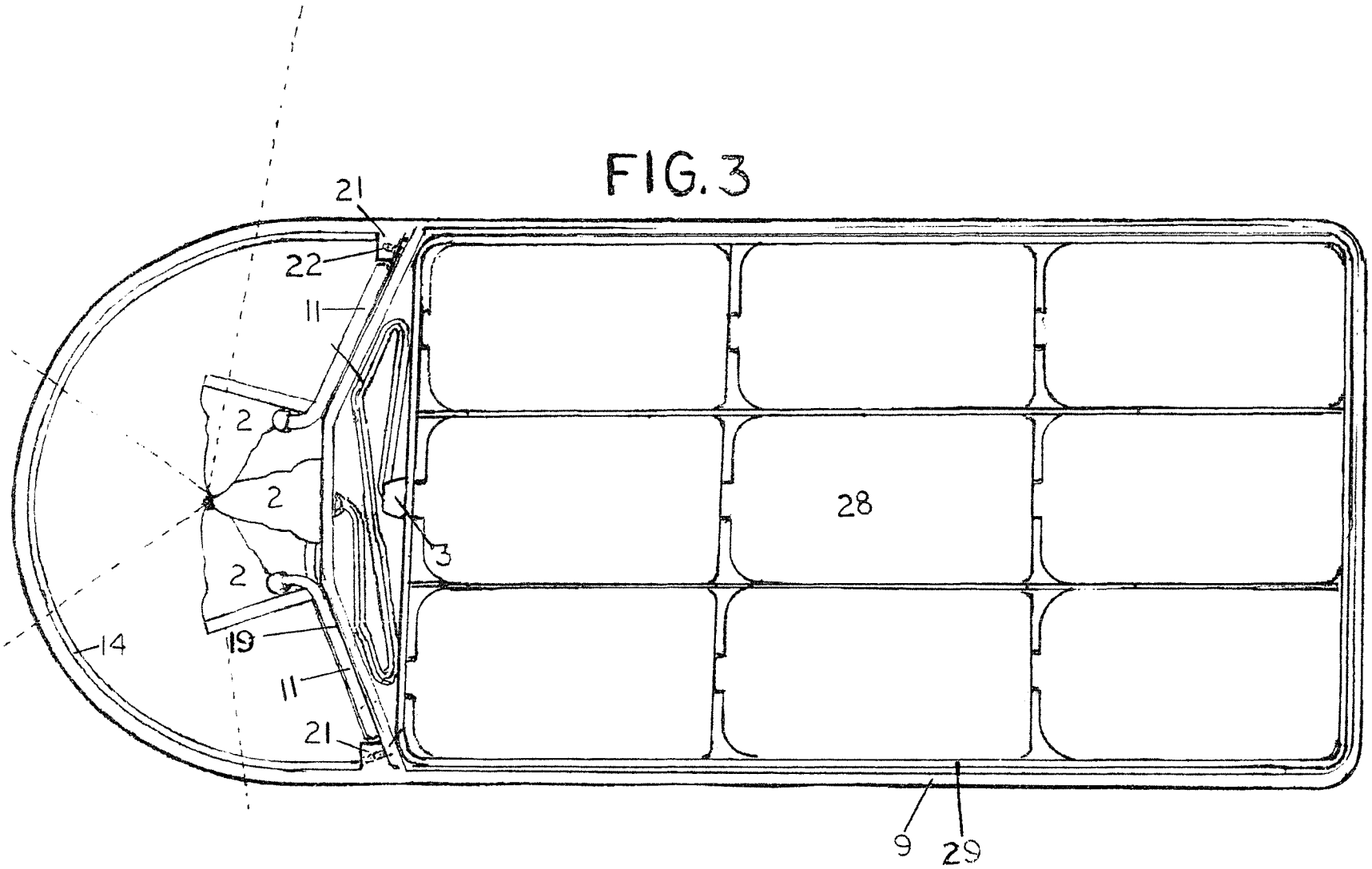

FIG. 3 is an overhead view of the surveillance device in the model of this device that possess infrared illuminators in an embodiment taught here in. This drawing shows as if the top portion of the surveillance device was removed to reveal the inner components in an embodiment taught herein. Number 2 are the combination cameras and WIFI transmitting modules. Number 14 is the forward viewing window where cameras #2 receive their surveilled image. Number 19 is a removeable wall; notice this wall extends up higher than the wall #23 illustrated in in FIG. 2B because this wall would extend up behind the infrared illuminators as well. This wall is also integral to the combination camera and WIFI transmitting modules mounting bases. This drawing also shows #29, a removable battery pack and batteries #28, in accordance with the principles of the present embodiment.

FIG. 4-A Is an overhead view of the surveillance device equipped with infrared illuminators in an embodiment taught herein, as if the outer forward portion of the housing #9 of the device was removed to reveal the infrared illuminators housed therein, although these light housings #7-D would actually be an integral part of the devices housing #9, in accordance with the principles of the present embodiment of the battery compartment lid #10.

FIG. 4-B is a slightly off skew image of removeable wall #19, integral to the camera mounting basses in an embodiment taught herein. Number 22 are mechanical fasteners for the attachment of the wall #19 to a cleat extending around the inner perimeter of the housing for the attachment of the wall #19, in accordance with the principles of the present embodiment.

Figure 5:
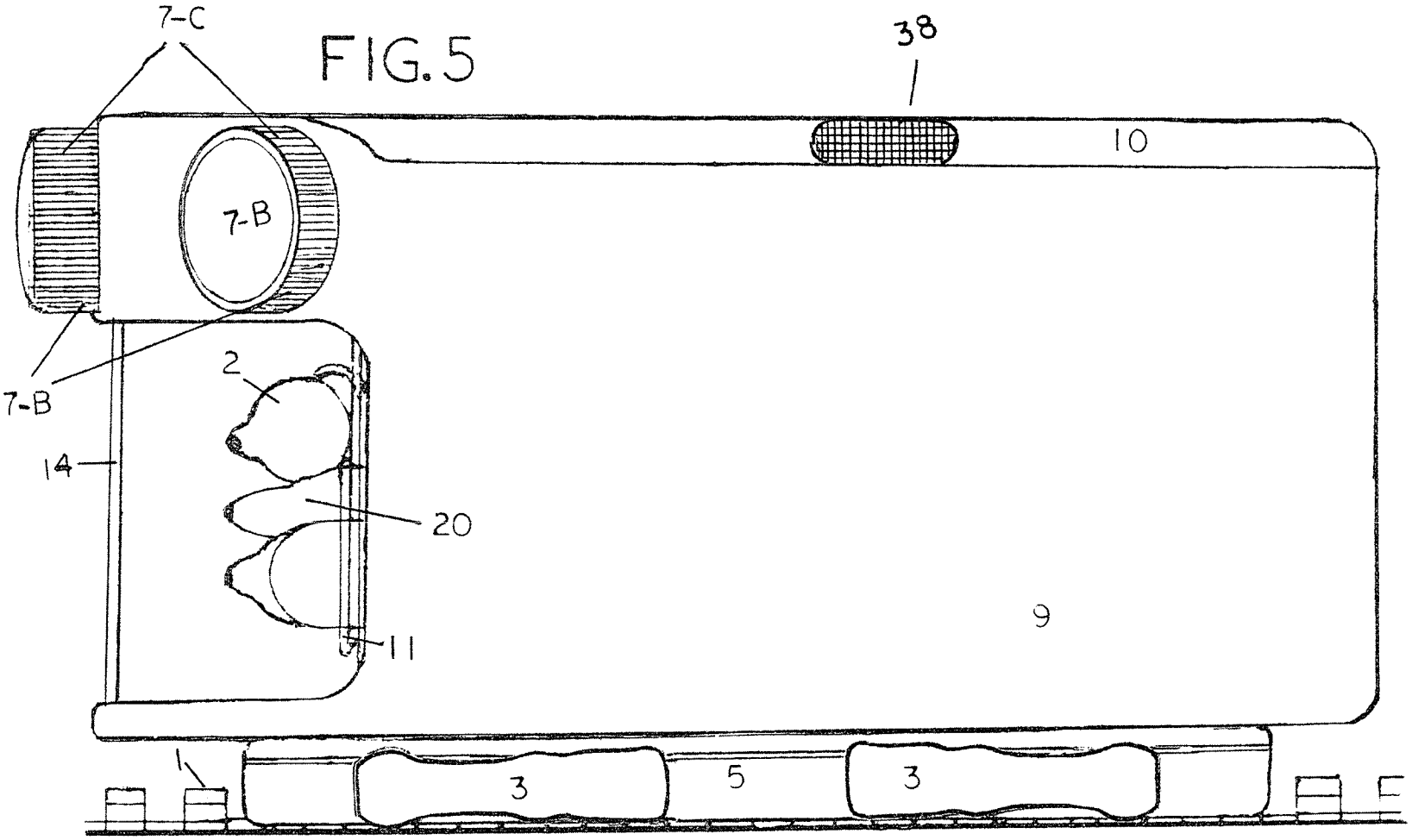

FIG. 5 Is a profile view of the surveillance device in an embodiment taught herein. Number 7-C are the infrared illuminator's lens housings and beam width adjustment knobs, #10 is the lid to the battery compartment in accordance with the principles of the present embodiment.

Figure 6:
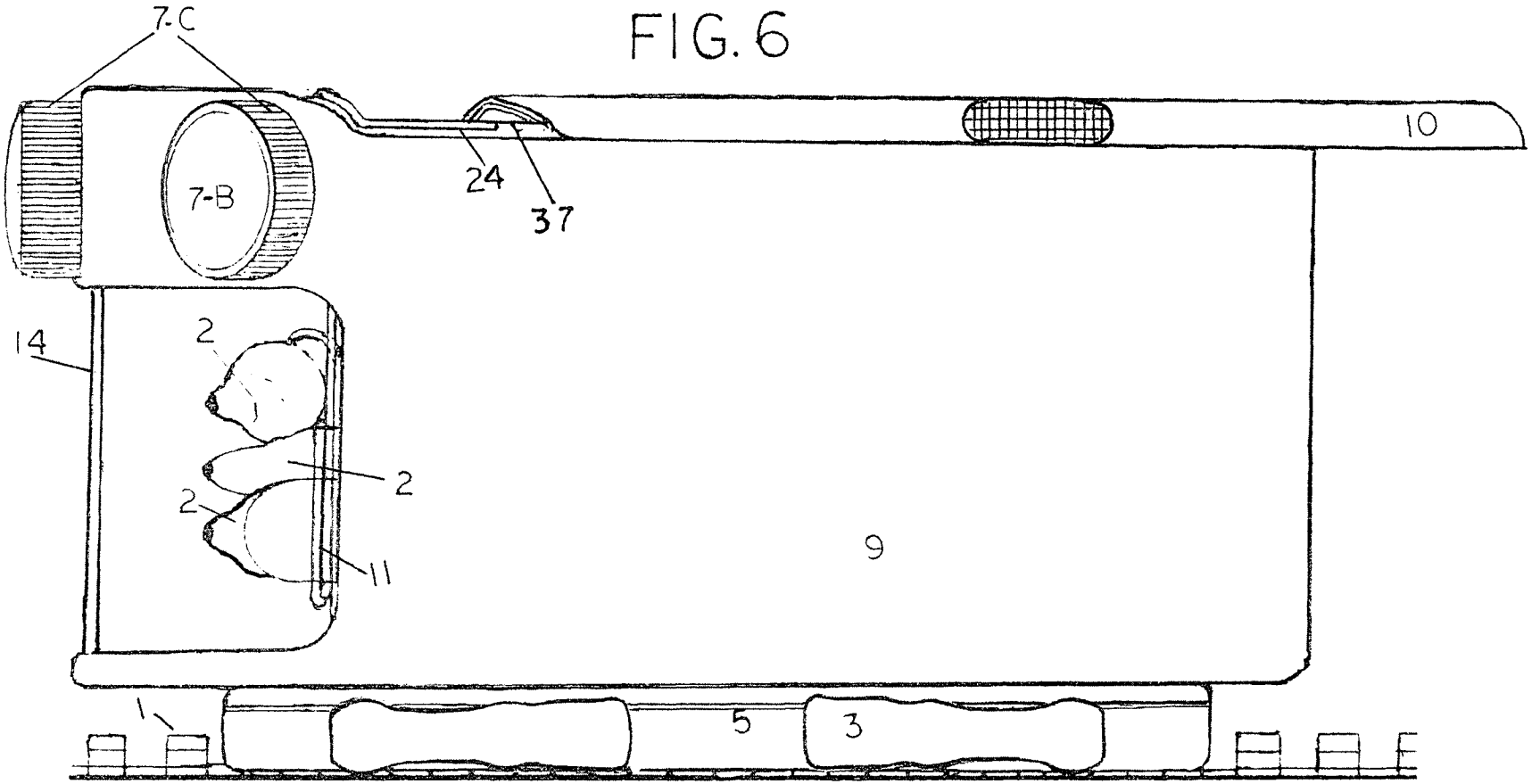

FIG. 6 Is a profile view of the surveillance device in an embodiment taught herein. Number 7-B is an infrared illuminator's lenses, #7-C are the rotatable knob portions of the infrared illuminators used to adjust beam width, #10 is the lid to the battery compartment. This drawing shows the battery compartment lid slid back to an approximate point where the lid would have to be slid back for removal and installment of battery pack and this lid #10 is in a partially opened positioned, in accordance with the principles of the present embodiment.

Figure 7:
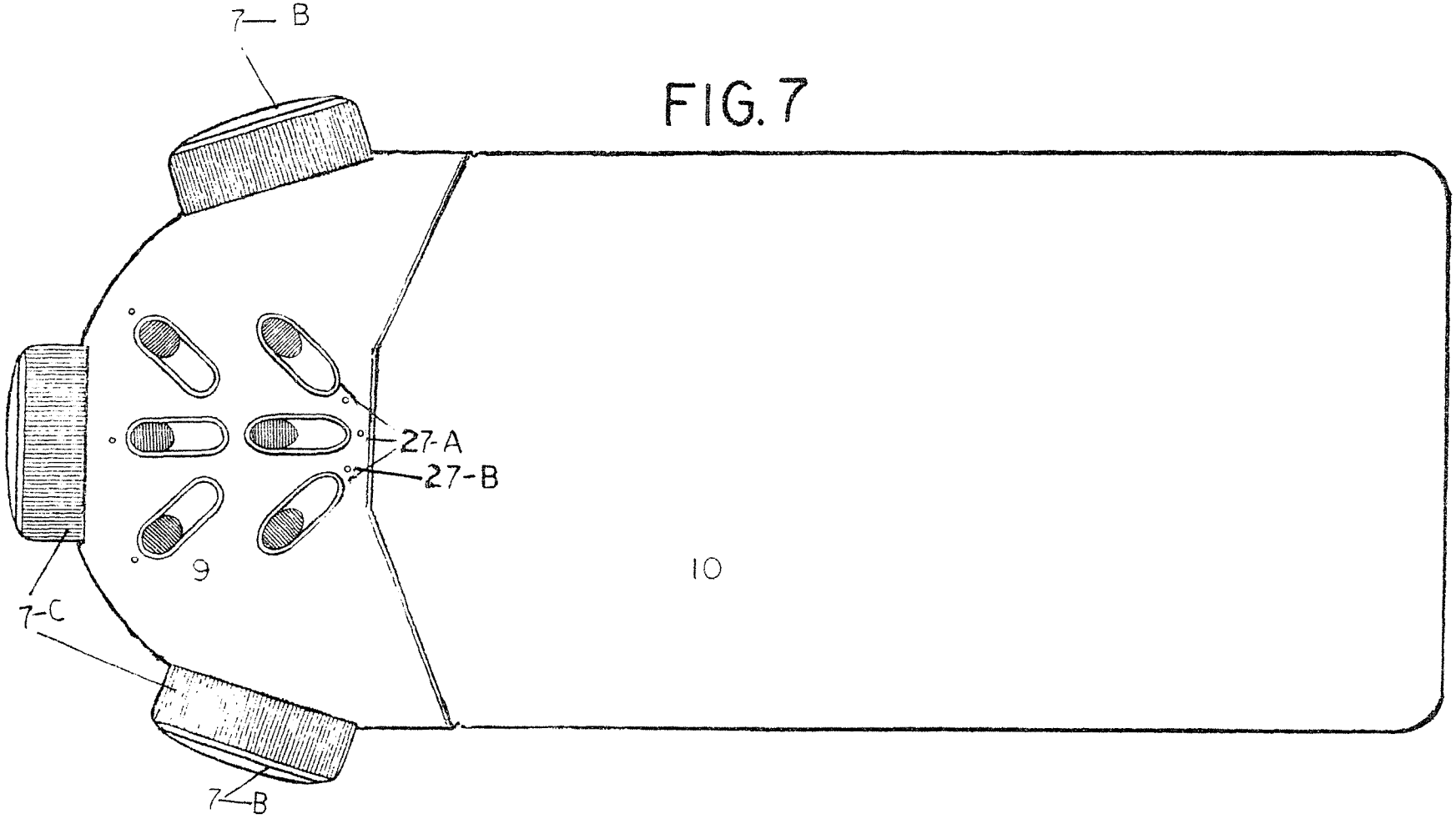

FIG. 7 Is an overhead view of the surveillance device with infrared illuminators incorporated into its housing #9 in an embodiment taught herein. Number 27A and #27B Are the switches and tiny indicator lights, for the combination camera and WIFI transmitting modules. Number 28-A and #28-B are the switches and tiny indicator lights, for the infrared illuminators in accordance with the principles of the present embodiment.

DETAILED DESCRIPTION

The present invention advantageously provides a tactical multiple camera surveillance device for the attachment to a firearm to provide the user with advanced knowledge of present and developing dangers in his soundings, all while the user remains totally behind protective cover, and providing a transmitted of such to be viewed by the user in a digital display. Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Referring now to the drawings figures in which like reference designators refer to like element.

The present invention advantageously provides a tactical multiple camera surveillance device for the attachment to a firearm to provide the user with advanced knowledge, of present and developing dangers in his soundings, while remaining totally behind protective cover while doing so and providing a transmitted image of such to be viewed by the user the digital display of a smart device.

Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art.

FIG. 1 is a profile view of a surveillance device attached to a firearm mounting rail #1 in an embodiment taught here in. Number 14 is the viewing window where three combination cameras and WIFI transmitting modules #2 receive their images from, in front and to each side, and partially behind the user. These cameras and WIFI transmitting modules are powered by a battery pack #29 (not shown) located inside aft inner portion of this device's housing #8 under lid #10. Number 5 is a rail mount; these rail mounts come in several different types and designs but all of which made as integral components of firearm accessories are for the attachment of firearm accessories of various types to the mounting rails #1. Mounting rails also come in several different types and this tactical surveillance device may be manufactured in models with rail mounts #5 of different types, as to be attachable to the different types of these mounting rails. The mounting rail in this drawing is a Picatinny rail being the most common type of these mounting rails which are found primarily on various types of rifles, but these mounting rails are also made in multiple configurations to be mounted on the tops sides and bottoms and of almost any type of firearm in accordance with the principles of the present embodiment.

Now referring to FIG. 2-A which is an overhead view of the surveillance device as if the top portion thereof was removed to reveal the inner components thereof in an embodiment taught herein. Number 2 are the combination cameras and WIFI transmitting modules, which are illustrated in these drawings as being of the type used in many of the higher quality portable types of spy cameras some of which are as illustrated, and others. WIFI transmitting modules and antennas are hardwired to their cameras and would be separately mountable these cameras are of the same basic types and quality employed in the higher quality smart phones with resolution ratings of 1080 pixels and greater their primary differences being the WIFI transmitting modules and these cameras also being available with infrared viewing abilities. These types of spy cameras lend themselves to this application very well, and rough prototypes made with these widely available over the counter spy cameras for this device have performed extremely well, meaning that with this device being proficiently built and devised to the highest of mill spec standards these tactical surveillance devices will perform amazingly well. Number 14 is the forward viewing window where cameras #2 receive their surveilled images. Number 23 is an optional design of a removeable wall that's integral to the camera mounting bases; this wall being removable and resealable is simply illustrated in this manner as a viable option that would provide both easy assemblage and access for possible future repairs or maintenance. This removable wall #23 is mechanically fasten able to a cleat #21 extending around the inner perimeter of and part of the housing #8 that wall #23 is attachable to. Number 32 is the wire that completes electrical communication between the removeable battery pack and the switches. Number 34 is an electrical plug that completes the circuit between the battery pack seen in FIG. 3A and wire #32 accordance with the principles of the present embodiment.

FIG. 2-B is a slightly off skew image of the removeable wall #23 integral to the combination camera and WIFI transmitting modules for mounting basses in an embodiment taught herein. Number 22 are mechanical fasteners for the attachment of the wall #23 to a cleat extending around the inner perimeter of the housing for the attachment of the wall #23. This wall was devised in this manner simply to facilitate access to the inner workings of this invention both for the purpose of assemblage as well as for the ability to remove and reseal this wall in the case future component access where needed for repair or replacement in accordance with the principles of the present embodiment.

FIG. 3 Is an overhead view of the surveillance device with a removeable battery pack #29. This battery pack is designed in this manner for several reasons, firstly to provide easy access to the access door #23 or #19, secondly so the entire battery pack could be quickly and easily removed and replaced, thirdly so the entire battery pack could either be recharged in place by plugging the unit into a wall or vehicle charger or removed and charged separately. This battery pack would also be partially opened both on the bottom and the top as to not retain moisture or contaminants, the same being true for the battery compartment portion of the device inside the housing itself, providing for all around ease of cleaning and maintenance. This battery pack's electrical communication with the rest of the device is both connected and removed by means of electrical plug #31. The mail portion of this plug would be of the same type as the male portion of the plug on the charger and the female or the receptacle portion of this plug on the battery pack itself would be of the same type and size as the charging port itself. Number 28 are the individual batteries that would both be removable and rechargeable.

FIG. 4-A Is an overhead view of the surveillance device equipped with infrared illuminators in an embodiment taught herein. This drawing is illustrated as if the outer forward portion of the housing #9 of the device was removed to reveal the infrared illuminators housed therein although these light housings #7-D would actually be an integral part of the devices housing #9. This drawing shows these infrared illuminators as being LED type infrared illuminators. The actual LED bulb access for removal and replacement would be accomplished by means of removal of the lens #7B and lens housing #7C which actually doubles as the beam width adjustment knob. Switches 28-A complete the circuit between the batteries and the individual infrared illuminators 27-A complete the circuit between the batteries and the individual combination cameras and WIFI transmitters #2 is wiring facilitating electrical communication between the power source and switches as well as between switches and infrared illuminators and switches and combination cameras and WIFI transmitters in accordance with the principles of the present embodiment.

FIG. 4-B is a slightly off skew image of removeable wall #19 integral to the camera mounting basses in an embodiment taught herein. Number 22 are mechanical fasteners for the attachment of the wall #19 to a cleat extending around the inner perimeter of the housing for the attachment of the wall #19. Notice wall #19 is basically of the same type and configuration as wall #23 in illustration 2-B, with the only difference being that this wall is vertically longer or higher. This simply due to the additional height of this design of the invention that's equipped with the infrared illuminators. The battery pack #29 illustrated in FIG. 3 would also be higher and contain an additional level or larger batteries for the power requirements of the infrared illuminators. Although these drawings actually show this device as having a much larger battery supply than it could possibly require to maintain an extended run time so the actual battery capacity as well as battery type and size would be made as an executive decision after proper power requirement assessments can be determined.

FIG. 5 Is a profile view of the surveillance device in an embodiment taught herein #7-C are the infrared illuminator's lens housings and beam width adjustment knobs #10 is the lid to the battery compartment. Number 5 is the rail mount which is an integral component of the devices housing #9. Number 3 is the handles to facilitate the actuation and disengagement of the rail mount #5. This is one of several different types of quick release rail mounts. The thumb screws #4 in FIG. 1 serve the same purpose as the handles #3. The textured and slightly raised portions of the sides of the battery compartment lid are to help facilitate the removal of same in accordance with the principles of the present embodiment.

FIG. 6 Is a profile view of the surveillance device in an embodiment taught herein. Number 7-B is an infrared illuminator's lenses, #7-C are the rotatable knob portions of the infrared illuminators used to adjust beam width, #10 is the lid to the battery compartment. This drawing shows the battery compartment lid slid back to an approximate point where the lid would have to be slid back for removal and installment of battery pack and this lid #10 is partially opened positioned, where the upper lip which is a latterly protruding portion #24 of the inset raised portion #37 for the lid #10. This latterly protruding portion #24 extends around and across the upper most forward and aft portions of the battery compartment and extends inward a short distance on the upper and outer most perimeter of the battery compartment creating a grove or dado, creating a track between the latterly protruding portions #24 of the inset raised portion #37 and the upper and outer most portion of the housing #9. Protruding inward from the outermost perimeter of the inside perimeter of the battery compartment lid #10 is an additional protruding portion creating a mail track sections, located in the same forward and aft portions of the lid #10, as to match up with the protruding portions #24 of track #37, creating an interlocking track so that by setting the lid on the top of the battery compartment in the same approximate location as illustrated or farther back. All one must do to attach, and solidly latch the battery compartment lid to the top of the battery compartment is to push the lid forward sliding same into the interlocking track and as the forward protruding portion of the lid reaches the forward raised portion of the upper perimeter of the battery compartment and pops over same latching same in place with the outer perimeter of the battery compartment lid remaining lower than the raised recessed portion and the uppermost portion of the protruding upper track portion of the battery compartment. This would also create a drip rail that would not only help seal the battery compartment lid #10 from contaminants but also keep moisture out. Then to remove the lid, one would simply grasp the sides of the lid by the textured handle portions #38 of the sides of the battery compartment lid and simply pulling same straight back and simply reversing the installment process, in accordance with the principles of the present embodiment.

FIG. 7 Is an overhead view of the surveillance device with infrared illuminators incorporated into its housing #9 in an embodiment taught herein. Number 27A and #27B are the switches and tiny indicator lights for the combination camera and WIFI transmitting modules and #28-A and #28-B are the individual switches for the infrared illuminators, #11 are tie antennas for the WIFI transmitters in accordance with the principles of the present embodiment.

What is claims is:

1. A surveillance system, comprising:

a housing dimensioned to enclose a camera;

one or more viewing windows to allow light to pass through the housing; and a transmitting module to send and receive wireless data via an antenna;

a mount attached to the housing to mount the housing to a firearm; and one or more infrared illuminators positioned on the housing, wherein at least a first infrared illuminator of the one or more infrared illuminators comprises a beam width adjustment knob.

2. The system of claim 1, wherein the camera is one of a plurality of cameras disposed within the housing, and the camera is a forward-mounted camera including a viewing window to permit a user to visualize a target.

3. The system of claim 2, further comprising a power source in electrical communication with the plurality of cameras, and the transmitting module.

4. The system of claim 3, wherein the transmitting module is in wireless communication with one or more external devices.

5. The system of claim 4, wherein the first infrared illuminator further comprises a lens on the beam width adjustment knob.

6. The system of claim 1, wherein the first infrared illuminator further comprises a lens on the beam width adjustment knob.

7. The system of claim 1, further comprising a forward viewing window permitting the camera to receive imagery from the front of the firearm.

8. The system of claim 1, wherein the surveillance system is disposable on a plurality of firearms.

9. The system of claim 8, wherein the mount releasably engages with the plurality of firearms.

10. The system of claim 3, wherein the power source is rechargeable.

11. A surveillance system, comprising:

a housing dimensioned to enclose a plurality of cameras, wherein at least one of the plurality of cameras is a forward-facing camera;

one or more viewing windows to permit the plurality of cameras to capture imagery; and a transmitting module to send and receive wireless data via an antenna;

a mount attached to the housing to mount the housing to a firearm; and one or more infrared illuminators positioned on the housing, wherein at least a first infrared illuminator of the one or more infrared illuminators comprises a beam width adjustment knob.

12. The system of claim 11, further comprising a power source in electrical communication with the plurality of cameras, and the transmitting module.

13. The system of claim 12, wherein the transmitting module is in wireless communication with one or more external devices.

14. The system of claim 13, wherein the first infrared illuminator further comprises a lens on the beam width adjustment knob.

15. The system of claim 11, wherein the first infrared illuminator further comprises a lens on the beam width adjustment knob.

16. The system of claim 11, wherein the surveillance system is disposable on a plurality of firearms.

17. The system of claim 16, wherein the mount releasably engages with the plurality of firearms.

18. The system of claim 12, wherein the power source is rechargeable.

* * * * *